US007762101B1

(12) United States Patent
Zuili et al.

(10) Patent No.: US 7,762,101 B1
(45) **Date of Patent: *Jul. 27, 2010**

(54) HIGHLY EFFICIENT COOLING SYSTEMS

(75) Inventors: Patrick Zuili, Boca Raton, FL (US); Daren Stabinski, Weston, FL (US); Todd Stabinski, Miami, FL (US); George Bitton, Boca Raton, FL (US); Jim Suggs, Margate, FL (US)

(73) Assignee: Powerquest, Inc., Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/563,128

(22) Filed: Sep. 19, 2009

(51) Int. Cl.
*F25D 11/00* (2006.01)

(52) U.S. Cl. ..... 62/430; 62/486

(58) Field of Classification Search ..... 62/430, 62/109, 185, 238.3, 238.6, 304, 305, 454, 62/486, 259.4, 419; 165/80.4, 907, 201, 165/207, 208

See application file for complete search history.

(56) References Cited

U.S. PATENT DOCUMENTS 3,306,353 A * 2/1967 Burne ..... 165/164
3,323,568 A * 6/1967 Schmidt ..... 81/44
3,339,260 A * 9/1967 Burne et al. ..... 29/890.036
3,364,951 A * 1/1968 Burne et al. ..... 138/38
3,415,316 A * 12/1968 Burne et al. ..... 165/164
3,595,310 A * 7/1971 Burne et al. ..... 165/161
3,776,303 A * 12/1973 Anderson et al. ..... 165/82
4,962,296 A * 10/1990 Ostbo ..... 392/484
5,141,720 A * 8/1992 Malmstrom et al. ..... 422/200
6,050,101 A 4/2000 Liu
6,074,972 A 6/2000 Bratton et al.
2003/0188538 A1* 10/2003 Chu et al. ..... 62/3.2
2004/0009383 A1* 1/2004 Michels et al. ..... 429/26
2005/0206293 A1* 9/2005 Taomoto et al. ..... 313/346 R
2006/0042294 A1 3/2006 Bacchus

* cited by examiner

*Primary Examiner*—Mohammad M Ali
(74) *Attorney, Agent, or Firm*—Joe Zheng

(57) ABSTRACT

Improved structures of cooling systems that may be used in air conditioning or refrigeration are described. To achieve a high efficiency in converting cooling effect from one or more cooling units, antifreeze liquid used to absorb the cooling effect is forced to pass through a box or container made out of graphite or thermally conductive metal or alloy holding a sponge-like structure or foam, also made out of graphite or thermally conductive metal or alloy, where the foam including open cells provides maximum surface contact with the liquid. Further the liquid is sprayed or vaporized onto the foam and passes through the foam by gravity or pressure. The cooled liquid is exited from the container for use in air conditioning or refrigeration.

14 Claims, 4 Drawing Sheets

HIGHLY EFFICIENT COOLING SYSTEMS

BACKGROUND OF THE INVENTION

1. Field of the Invention

The invention is generally related to the area of air conditioning systems or refrigeration. More particularly, the present invention is related to cooling systems with a unique structure to deliver cooling effect in highly efficient way, where the cooling systems use less energy than the prior art systems do and can be used in air conditioning systems or refrigeration.

2. The Background of Related Art

Prior to the introduction of Freon in 1928, the air conditioning industry relied on dangerous, toxic, and/or flammable liquids and gases to act as refrigerants. In 1928, chlorofluorocarbon compounds such as Freon were introduced and deemed to be more efficient and effective refrigerants for air conditioning systems. However, such compounds if released into the atmosphere were discovered to cause severe environmental effects, such as the depletion of the ozone layer, and contribute to the global warming.

Currently standard refrigerants (e.g., R-22) are scheduled to be phased out in new equipment by 2010, and completely discontinued by 2020. However, the newer refrigerants prove to cause similar environment impact of its predecessors. Moreover, the traditional split air conditioning system, comprised of a compressor and air handler, uses a large amount of electricity to perform the cycle of evaporating and then condensing the chlorofluorocarbon refrigerants to cool down the refrigerants and run them through the air handler. The process causes further environment effects such as depletion of fossil fuels, as well as being expensive to the end user, especially with the recent rises in the cost of such fuels.

One other aspect of the traditional air conditioning compressor is its high noise level, which requires the unit to be placed outside and some distance away from the air handler, which in turn causes a loss of efficiency due to temperature lost from its travel from the compressor to the air handler.

Water was used as early as in the 2nd century during the Chinese Song Dynasty as a coolant into rudimentary fans as air conditioning. Even today, water is being used in large industrial and commercial water chilled air conditioning systems. However using traditional evaporative and condensing mechanism uses a large amount of energy. Thus there is a need for energy efficient, environmental friendly, and quiet air conditioning systems.

SUMMARY OF THE INVENTION

This section is for the purpose of summarizing some aspects of the present invention and to briefly introduce some preferred embodiments. Simplifications or omissions in this section as well as in the abstract or the title of this description may be made to avoid obscuring the purpose of this section, the abstract and the title. Such simplifications or omissions are not intended to limit the scope of the present invention.

In general, the present invention pertains to highly efficient cooling systems. According to one aspect of the present invention, an air conditioning system runs an energy-efficient water chilled mechanism that can be used on smaller scales as well as large properties. The air conditioning system achieves peak efficiency by using unique physical properties of solid carbon graphite, carbon graphite and/or metallic foam, and misters to achieve maximum thermal conductivity from absorption to water.

According to another aspect of the present invention, two cooling units are used to sandwich a container made out of a type of metal, carbon graphite, or combination thereof, with high conductivity. The container is structured to include a metal foam in contact with the container being sandwiched by the two cooling units. As a result, liquid in the container is substantially cooled to provide a cooled source for air conditioning or refrigeration.

There are numerous functions, benefits and advantages in the present invention, one of them is that the present invention provides new structures for a cooling system that may be used in air conditioning or refrigeration. The present invention may be implemented in numerous foams. According to one embodiment of the present invention, the present invention is a cooling system comprising: a container including an inlet and outlet, a foam included and expanded in the container so that the foam is in close contact with the container, and two cooling units sandwiching the container to transfer cooling effects to the container, where a type of liquid is supplied from the inlet to pass the foam to be cooled, and the cooled liquid exits from the outlet.

According to another embodiment of the present invention, the present invention is a cooling system comprising: a container including an inlet and outlet, a foam included and expanded in the container so that the foam is in close contact with the container, where the foam is made out of a material with high thermal conductivity, and allows for optimal surface area of cooling, the foam includes open cells, two cooling units sandwiching the container to transfer cooling effects to the container then the foam inside the container, where a type of liquid is supplied from the inlet to be sprayed over the foam that passed through the foam by gravity and/or pressure, and the outlet exits the liquid that has been cooled when going through the container.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

The present invention pertains to new structures of cooling systems that may be used in air conditioning or refrigeration. To achieve a high efficiency in converting cooling effect from one or more cooling units, antifreeze liquid used to absorb the cooling effect is forced to pass a box or container holding an open-cell sponge-like structure or foam, where the foam including atomic holes provides maximum surface contact with the liquid. Further the liquid is sprayed or vaporized onto the foam and the liquid passed through the foam by gravity.

The cooled liquid is exited and pumped from the container for use in air conditioning or refrigeration.

The detailed description of the present invention is presented largely in terms of procedures, steps, logic blocks, processing, or other symbolic representations that directly or indirectly resemble the operations of devices or systems that produce coldness or cooling effect. These descriptions and representations are typically used by those skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams or the use of sequence numbers representing one or more embodiments of the invention do not inherently indicate any particular order nor imply any limitations in the invention.

One of the important features, advantages and objectives in the present invention is the use of two cooling units to cool down a container being sandwiched by the two cooling units. The container containing at least a sponge-like structure or foam that is expanded within the container to be closely in contact therewith. The container itself is made out of a type of material with high thermal conductivity. The foam is also made out of a type of material with high thermal conductivity. Each of the cooling units operates on absorptive refrigeration that uses a source of heat to provide the energy needed to drive the cooling process. According to one embodiment, the source of heat is provided by solar energy. With solar panels being exposed to the sun, electricity is generated to power the source of heat to heat up a type of liquid being used in the cooling units. In another embodiment, the source of heat is provided by conventional electric resistance heater. Examples of the liquid used as refrigerant include, but not be limited to, ammonia, hydrogen, and water.

Figure 1:
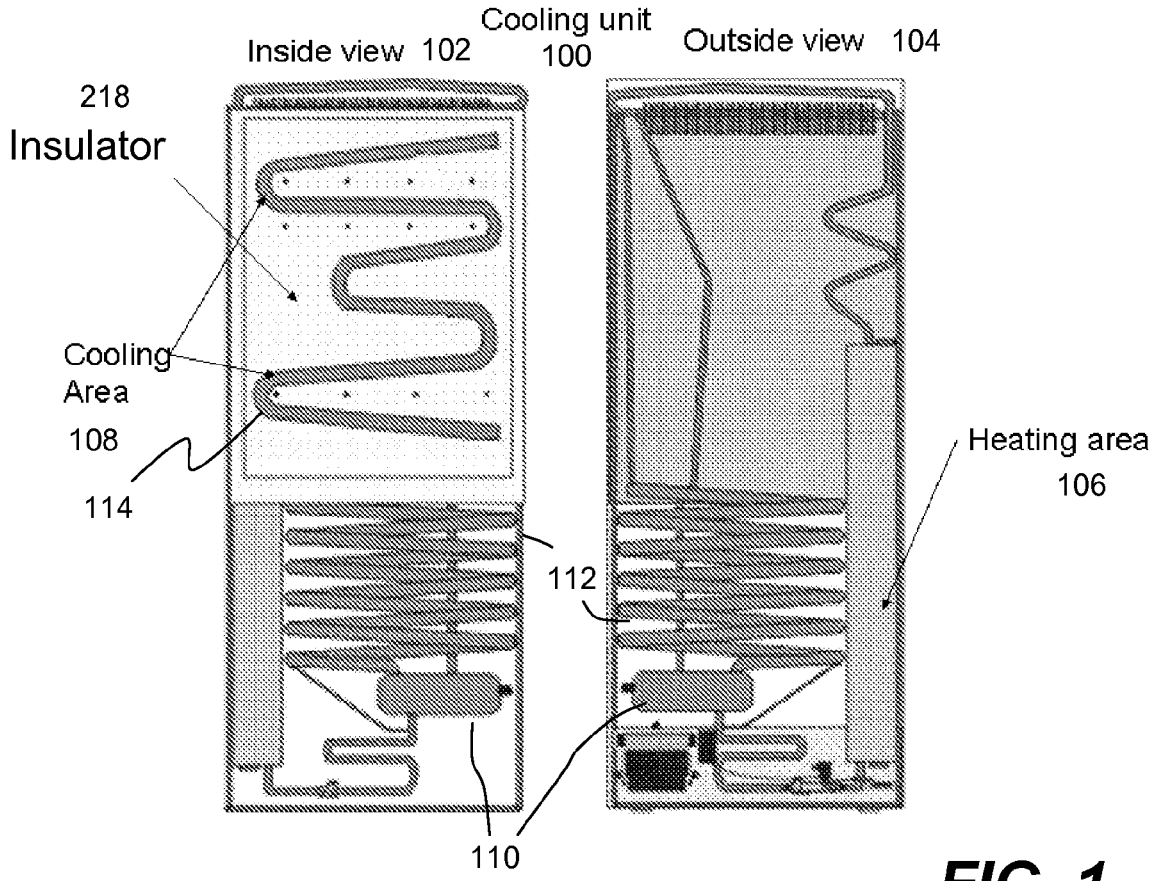
FIG. 1 shows a cooling unit that may be used in one embodiment of the present invention.

Referring now to the drawings, in which like numerals refer to like parts throughout the several views. FIG. 1 shows a cooling unit 100 that may be used in one embodiment of the present invention. As shown in FIG. 1, the cooling unit 100 is shown in two views, referred to herein as an inside view 102 and an outside view 104. The cooling unit 100 comprises a heating area 106, a cooling area 108, an absorber tank 110, and absorber 112. The heating area 106 includes a boiler (not separately shown) powered by energy provided externally. In one embodiment, the energy is from electricity generated from solar. In another embodiment, the energy is from battery or conventional electric power.

The boiler heats up a type of working fluid (e.g. ammonia) coming from the absorber tank 110. To facilitate the description of the invention, ammonia will be used herein. As a result of the ammonia liquid being heated, the ammonia liquid vaporizes. The ammonia vapor is led to pass into the cooling area 108, where there is a set of coils or bending pipes 114 that make up a rectifier and an evaporator. The rectifier is just a slightly cooler section of the pipes 114 that cause the vapor to condense and drop back downwards. An optional separator (not shown) at the top of the cooling unit 100 prevents any liquid that might have escaped the rectifier to condense and fall back. After this point, the vapor is delivered to the condenser. A condenser is where the cooled air passing through to cool down the ammonia vapor. The cooling effect of the condenser with an array of metal fins forces the ammonia vapor to condense to a liquid state.

The liquid ammonia enters the evaporator (or a freezer) and trickles down the pipes, wetting the wall thereof. Hydrogen, supplied through an inner pipe of the evaporator, passes over the wetted wall, causing the liquid ammonia to evaporate into the hydrogen atmosphere at an initial temperature of around −20° F. The evaporation of the ammonia extracts heat from the surrounding (e.g., a freezer). In operation, at the beginning stages, the pressure of the hydrogen is around 350 psi (pounds per square inch), while the pressure of the liquid ammonia is near 14 psi. As the ammonia evaporates and continues to trickle down the tube, its pressure and therefore its evaporation temperature rise.

The liquid ammonia entering the high temperature evaporator (cooling portion) is around 44 psi while the pressure of the hydrogen has dropped to 325 psi. Under these conditions, the evaporation temperature of the liquid ammonia is +15° F. Heat is removed from the surrounding through the fins attached to the high temperature evaporator. The ammonia vapor created by the evaporation of the liquid ammonia mixes with the already present hydrogen vapor, making it heavier. Since the ammonia and hydrogen vapor mixture is heavier than the purer hydrogen, it drops down through the evaporators, through the return tube to the absorber tank.

When the ammonia and hydrogen vapor mixture enters the absorber tank 110 through the returning tube or absorber 112, much of the ammonia vapor is absorbed into the surface of the rich ammonia solution while going through the absorber 112. The rich ammonia solution occupies the lower half of the tank 110 while lighter ammonia and hydrogen mixture (now with less ammonia) begins to rise up in the absorber 112 (coils). The weak ammonia solution trickling down the absorber coils 112 from the top (generated by the boiler) is "hungry" for the ammonia vapor rising up the absorber coils with the hydrogen. This weak ammonia solution eventually absorbs all the ammonia from the ammonia and hydrogen mixture as it rises, allowing pure hydrogen to rise up the inner pipe of the evaporator section and once again do its job of passing over the wetted walls of the evaporator. The absorption process in the absorber section generates heat, which is dissipated.

Figure 2A:
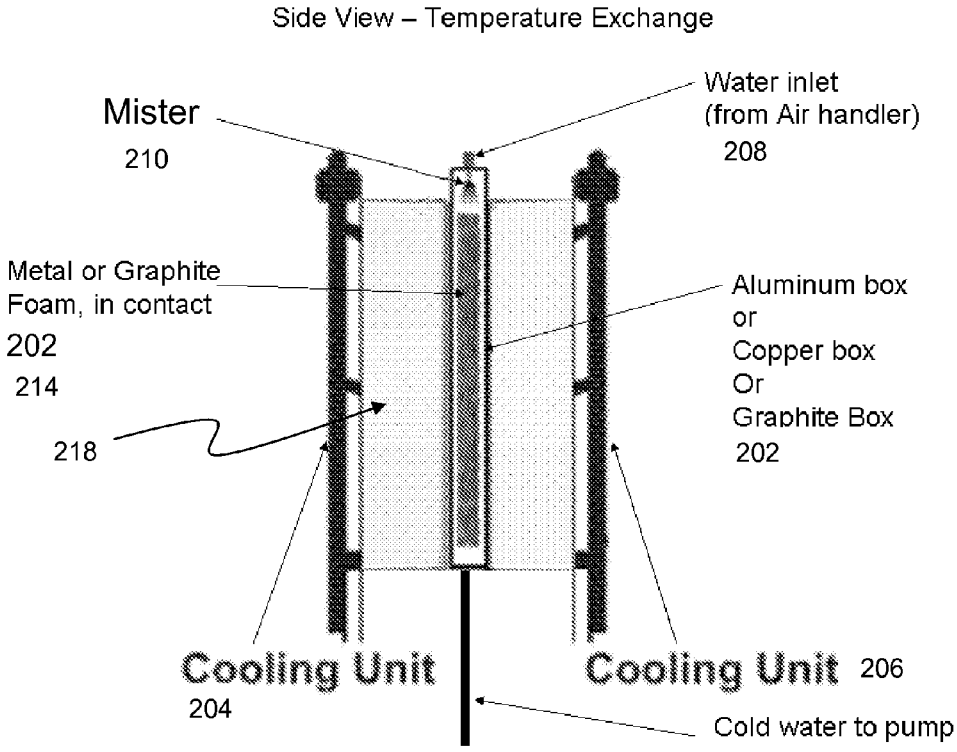
FIG. 2A shows a side view of a structure with a container being sandwiched by two cooling units.
Figure 2B:
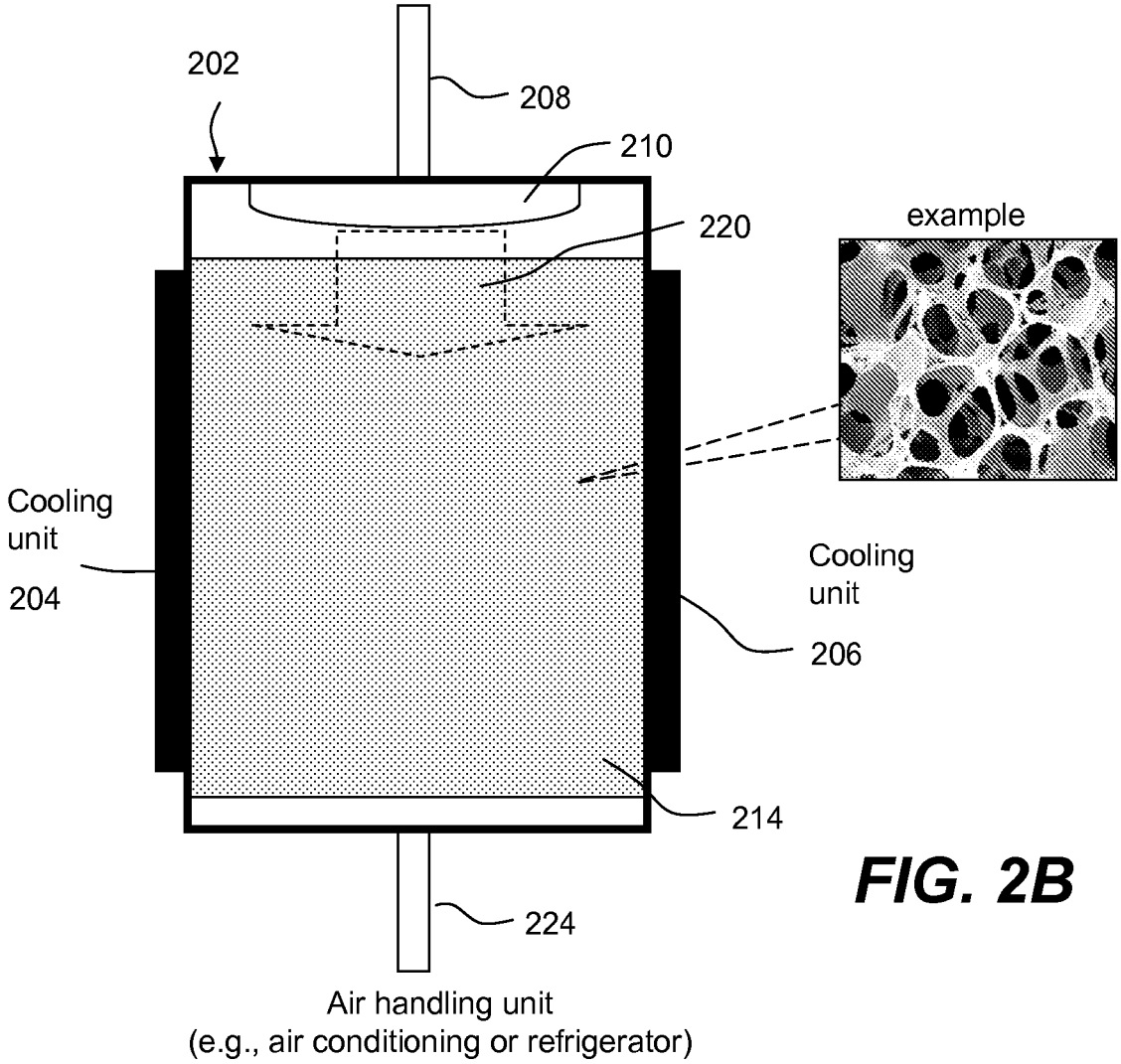
FIG. 2B shows a detailed structure of the container used in FIG. 2A.

Referring now to FIG. 2A, it shows a side view of a structure 200 with a container 202 being sandwiched by two cooling units 204 and 206 according to one embodiment of the present invention. The cooling unit 100 of FIG. 1 may be used. The container 202 is preferably made of graphite, but could also be made of aluminum, copper, or any other thermoconductive metal or alloy including non-metallic ceramic. The container 202, as further shown in FIG. 2B, includes a foam 214 made out of graphite or a metal material with high thermal conductivity. The foam 214 is expanded within the container 202 to be closely in contact therewith so that coldness or cooling effect from the two cooling units 204 and 206 can be effectively transferred therein. In one embodiment, on top of the container 202 there is an optional gasket (for maintenance) and a liquid (or gas) inlet 208. A mister 210 is employed to be connected to the inlet 208.

In operation, a type of liquid (e.g., antifreeze liquid) is supplied to the inlet 208 that causes the mister 210 to spray or vaporize the liquid into the foam 214. By gravity, the mist 220 falls inside cells of the foam 214. In one embodiment, the foam 214 similar to a sponge-like structure, is made out of graphite with open cells measured, for example, between 10-100 PPI (pores per inch) in size. As the mist 220 falls downwards, the liquid passed through the foam 214. From another perspective, the liquid is having the maximum surface contact with the foam 214. As a result, the cooling effect or coldness from the two cooling units 204 and 206 is transferred to the liquid in maximum efficiency. The cooled liquid exits to an outlet 224 at its coldest temperature.

It should be noted in FIG. 2A that the coils or tubes (not shown) in the two cooling units 204 and 206 that produce the cooling effect are entrenched in insulator 218 and are in close contact with the container 202 to transfer the cooling effect. According to one embodiment, thermo-conductive paste is used to ensure that maximum transfer of the cooling effect to the container 202 is achieved.

The cooled liquid from the outlet 224 can optionally go to a tank then to a pump, or directly to a pump connected (using any tubing) to an evaporator cooling coil located inside an air handler that receive the cold liquid, transported by the pump. In one embodiment, the liquid goes through copper tubing surrounded by aluminum fins, the air going through the fins becomes cold and moved by a blower to ducts. The liquid during this process heats up and comes back to the container 202 to get cooled again in a closed loop.

As indicated above, the invention as described herein provides an energy efficient liquid chilled system that can be used on smaller scales as well as large properties, and forgoes the high energy consumption of a traditional compressor for the lower energy usage of an absorption cooling system. A system built per the present invention achieves peak efficiency by using the unique physical properties of solid carbon graphite, carbon graphite and/or metallic foam, and misters to achieve the maximum thermal conductivity from the absorption cooling system to the liquid.

According to one embodiment, the present invention is implemented as a central air conditioning system, where a blower (e.g., air handler) receives a cold liquid or gas (less than 45F), that is pumped from a carbon graphite reservoir that is sandwiched between two or more absorption cooling units, and where the solid carbon graphite reservoir is filled with a graphite and/or metal (copper, aluminum, silver, alloy, etc.) foam. The thermal conductivity properties of the graphite within the reservoir and the foam provide a high thermal transfer rate between the cold absorption cooling units and the liquid or gas. This liquid or gas is used to cool the air that blows through the air handler coil. The liquid or gas is then pumped back or recycled to the top of the graphite reservoir, where there is a mister (if it is in liquid form) that atomizes the molecules of the liquid, and acts as initial cooling of the liquid, which is then sprayed back into the graphite reservoir to repeat the cooling cycle.

The thermodynamic exchange is maximized in the present invention due to the porosity of the foam which increases the surface cooling area exponentially. Furthermore, the unique thermal properties of the carbon graphite within the reservoir and/or the foam stores the cold temperature, therefore allowing a constant thermal conduction, rapid recovery, at a constant temperature, using minimal power.

Depending on implementation, the foam (e.g., the foam 214) by itself can be made of one metal or graphite or alloy, or a combination of different foams, without any limitations in size or orders. Certain metals such as silver may be included for the additional effect of cleaning the water within the unit and preventing the growth of mold and bacteria.

The liquid or gas being circulated can be water alone, water with glycol (antifreeze), in any proportion, or any gas like CO2, Helium, or hydrogen. If a gas is used, the unit will be sealed under pressure to maintain gas thermo effectiveness.

In one embodiment, an optional mechanism of (electronically) controlled tanks is provided before the mist and/or before the pump (cold outlet) to run the pump at an optimal rate, as well as run the absorption cooling units to maintain optimal energy efficiency. The unit may also include an optional compressor, or use an existing compressor, to initially cool the unit if the unit has not been recently used. The energy usage is sufficiently efficient to run on 12 volts, and permit the entire air conditioning system to run on solar panels or other alternative energy source.

Figure 3:
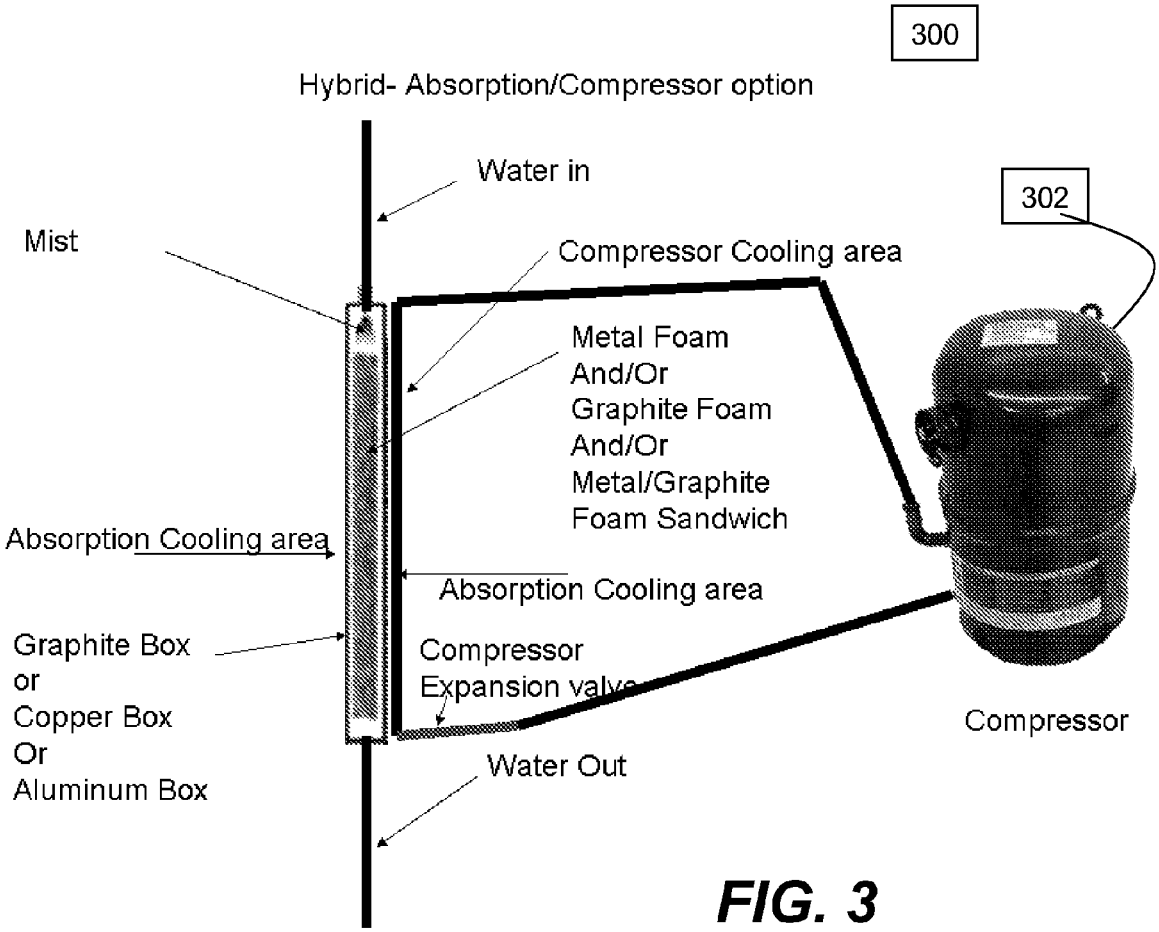
FIG. 3 shows an embodiment in which a compressor is used.

Referring now to FIG. 3, it shows a hybrid configuration 300 in which a compressor 302 is used. Due to the absorptions cycles, it may take sometime for the two absorptions units to work at efficient temperatures or setup load, then an optional compressor may be provided to perform the task to cool down the container 202 of FIG. 2A or 2B. As a result, the waiting time after installation or if the unit has been turned off can be minimized to have the system fully ready to cool down the air. In an event that an external temperature rises up to a point that will make the absorptions cycles difficult then the compressor will help maintaining the proper temperature, despite the sporadic usage of the compressor will still provide an high level of energy efficiency while providing an acute temperature control level.

Like any other HVAC system, a thermostat connected to the air handler is used to control the operations of an air conditioning unit implemented in accordance with the present invention. Typically, the surrounding of the two cooling units is vented, the coils or pipes are properly insulated using any material (e.g., insulation foam, closed cells glass foam). A venting area located at the bottom of the cooling units as well as a small fan located at the top of the units are used to discharge the heat to an external air vent outside a building (outside air).

The present invention has been described in sufficient details with a certain degree of particularity. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the foregoing description of embodiments.

We claim:

1. A cooling system comprising:

a container made out of a material with high thermal conductivity and including an inlet and outlet;

a thermal conductive foam included and expanded in the container so that the foam is in close contact with the container; and two cooling units sandwiching the container to transfer cooling effects to the container and the foam therein, each of the cooling units including a heating area, a cooling area, an absorber tank, and an absorber, wherein the heating area heats up a type of working fluid from the absorber tank, vapor from the working fluid is condensed in the cooling area and then goes through the absorber, wherein a type of antifreeze liquid is supplied from the inlet to pass through the foam to be cooled, the foam including open cells to provide a maximum surface contact between the liquid and the foam, and the cooled liquid subsequently exits from the outlet.

2. The cooling system as recited in claim 1, wherein the material is graphite, aluminum, copper, or other thermally conductive metal or alloy.

3. The cooling system as recited in claim 1, wherein the foam is made out of a highly thermal conductive material.

4. The cooling system as recited in claim 3, wherein the liquid after being cooled in the container is used to cool down air in an air handling unit.

5. The cooling system as recited in claim 3, wherein the liquid after being cooled in the container is used to cool down an enclosure in a refrigerator.

6. A cooling system comprising:

a container made out of a type of material with high thermal conductivity and including an inlet and outlet;

a thermal conductive foam included and expanded in the container so that the foam is in close contact with the container; and two cooling units sandwiching the container to transfer cooling effects to the container and the foam therein, each of the cooling units including a heating area, a cooling area, an absorber tank, and an absorber, wherein the heating area heats up a type of working fluid from the absorber tank, vapor from the working fluid is condensed in the cooling area and then goes through the absorber, wherein a type of antifreeze liquid is supplied from the inlet to pass through the foam by gravity or pressure, the foam includes open cells to provide a maximum surface contact between the liquid and the foam, and the cooled liquid exits from the outlet to cool surrounding air or objects and is recycled to go through the container.

7. The cooling system as recited in claim 6, wherein the material is graphite, aluminum, copper or other thermally conductive metal or alloy.

8. The cooling system as recited in claim 7, wherein the foam is made out of a highly thermal conductive material.

9. The cooling system as recited in claim 6, wherein the liquid after being cooled in the container is used to cool down an enclosure in a refrigerator.

10. A cooling system comprising a container made out of a material with high thermal conductivity and including an inlet and outlet;

a thermal conductive foam included and expanded in the container so that the foam is in close contact with the container; and two cooling units sandwiching the container to transfer cooling effects to the container and the foam therein, each of the cooling units operating using a compressor, wherein the each of the cooling units includes a heating area, a cooling area, an absorber tank, and an absorber, the heating area heats up a type of working fluid from the absorber tank, vapor from the working fluid is condensed in the cooling area and then goes through the absorber, and wherein a type of antifreeze liquid is supplied from the inlet to pass through the foam to be cooled, the foam including open cells to provide a maximum surface contact between the liquid and the foam, and the cooled liquid subsequently exits from the outlet.

11. The cooling system as recited in claim 10, wherein the material is graphite, aluminum, copper, or other thermally conductive metal or alloy.

12. The cooling system as recited in claim 10, wherein the foam is made out of a highly thermal conductive material.

13. The cooling system as recited in claim 12, wherein the liquid after being cooled in the container is used to cool down air in an air handling unit.

14. The cooling system as recited in claim 13, wherein the liquid after being cooled in the container is used to cool down an enclosure in a refrigerator.

* * * * *